US010231599B2

(12) United States Patent
Kulkarni et al.

(10) Patent No.: US 10,231,599 B2
(45) Date of Patent: Mar. 19, 2019

(54) LOWER RACK ASSEMBLY FOR DISHWASHER APPLIANCE

(71) Applicant: General Electric Company, Schenectady, NY (US)

(72) Inventors: Ashutosh Kulkarni, Bangalore (IN); Thana Pratap Tirunagari, Hyderabad (IN)

(73) Assignee: HAIER US APPLIANCE SOLUTIONS, INC., Wilmington, DE (US)

( * ) Notice: Subject to any disclaimer, the term of this patent is extended or adjusted under 35 U.S.C. 154(b) by 270 days.

(21) Appl. No.: 15/082,272

(22) Filed: Mar. 28, 2016

(65) Prior Publication Data

US 2017/0273538 A1 Sep. 28, 2017

(51) Int. Cl.
*A47L 15/42* (2006.01)
*A47L 15/50* (2006.01)

(52) U.S. Cl.
CPC ..... *A47L 15/506* (2013.01); *A47L 15/428* (2013.01); *A47L 15/4293* (2013.01)

(58) Field of Classification Search
CPC ... A47L 15/506; A47L 15/428; A47L 15/4293
See application file for complete search history.

(56) References Cited

U.S. PATENT DOCUMENTS 22,936 A 11/1947 Wilson
3,390,930 A 7/1968 Peterson
5,115,822 A 5/1992 Nichols
5,409,309 A * 4/1995 Giddings ..... A47L 15/507 134/201
5,971,513 A 10/1999 Cassalia
6,247,771 B1 6/2001 Miller
6,510,858 B1 1/2003 Halstead et al.
7,621,605 B2 11/2009 Bond et al.
7,731,805 B2 6/2010 Banta et al.
8,162,419 B2 4/2012 Dellby et al.
8,303,053 B2 11/2012 Bond et al.
(Continued)

FOREIGN PATENT DOCUMENTS

EP 1066789 A1 1/2001
JP H10179495 A 7/1998
(Continued)

*Primary Examiner* — Joseph L. Perrin
*Assistant Examiner* — Irina Graf
(74) *Attorney, Agent, or Firm* — Dority & Manning, P.A.

(57) ABSTRACT

A lower rack assembly for a dishwasher appliance includes a lower rack and a lift assembly connected to the lower rack. The lift assembly includes a gear assembly that includes an output spur gear and an input drive gear, and includes a first arm extending between a first end and a second end, the first end of the first arm pivotally coupled to the lower rack, the second end of the first arm coupled to the output spur gear. Movement of the input drive gear causes movement of the lower rack along the transverse direction between a retracted position wherein the lower rack is within the wash chamber and an extended position wherein the lower rack is positioned outside of the wash chamber and along the vertical direction between a lowered position and a raised position wherein the raised position is above the lowered position along the vertical direction.

12 Claims, 10 Drawing Sheets

(56) References Cited

U.S. PATENT DOCUMENTS

| | | | | |
|---|---|---|---|---|
| 2003/0042825 | A1* | 3/2003 | Welch | A47L 15/504 312/228.1 |
| 2011/0266936 | A1* | 11/2011 | Moran | A47B 51/00 312/312 |
| 2014/0001425 | A1* | 1/2014 | Falcon | A47B 51/00 254/133 R |
| 2014/0036434 | A1* | 2/2014 | Jau | G06F 1/16 361/679.33 |
| 2014/0239788 | A1* | 8/2014 | Turner | F24C 15/16 312/350 |
| 2017/0027413 | A1* | 2/2017 | Gerstner | A47L 15/506 |

FOREIGN PATENT DOCUMENTS

| | | | | |
|---|---|---|---|---|
| JP | 2001212062 | A | 8/2001 | |
| JP | 2006141516 | A | 6/2006 | |
| WO | WO-2008038320 | A1 * | 4/2008 | A47L 15/506 |
| WO | WO2014102367 | A1 | 7/2014 | |
| WO | WO-2015091646 | A1 * | 6/2015 | A47L 15/506 |
| WO | WO-2015165606 | A1 * | 11/2015 | A47L 15/506 |
| WO | WO-2016008678 | A1 * | 1/2016 | A47L 15/506 |

* cited by examiner

LOWER RACK ASSEMBLY FOR DISHWASHER APPLIANCE

FIELD OF THE INVENTION

The present subject matter relates generally to dishwasher appliances, and more particularly to lower rack assemblies for use in dishwasher appliances.

BACKGROUND OF THE INVENTION

Dishwasher appliances generally include a tub that defines a wash chamber. Rack assemblies can be mounted within the wash chamber of the tub for receipt of articles for washing. Spray assemblies within the wash compartment can apply or direct wash fluid towards articles disposed within the rack assemblies in order to clean such articles. Multiple spray assemblies can be provided including e.g., a lower spray arm assembly mounted to the tub at a bottom of the wash compartment, a mid-level spray arm assembly mounted to one of the rack assemblies, and/or an upper spray assembly mounted to the tub at a top of the wash compartment. Other configurations may be used as well.

Typically, the lower rack of a dishwasher is pulled out from the wash chamber for loading and unloading of dishes. A dishwasher door pivots into an open, generally horizontal position and may define a surface having one or more tracks for receiving wheels rotatably mounted on the lower rack. The lower rack is rolled out of the tub onto the open dishwasher door to simplify the loading or unloading process, e.g., by not requiring a user to reach into the wash chamber to add or remove dishes. However, even when the rack is extended outside the wash chamber, consumers must often bend over to reach the dishes located in the lower rack, resulting in discomfort and ergonomic issues. While some dishwashers have incorporated means for lifting the lower rack, these mechanisms often lift the lower rack in a jerky and non-uniform manner. Alternatively, these systems are complex, expensive, and difficult to maintain.

Accordingly, a dishwashing appliance having apparatus for lifting the lower rack when loading or unloading dishes would be useful. More particularly, cost effective rack lifting apparatus that may lift the lower rack in a smooth and uniform manner to provide a simple, ergonomic method of loading and unloading dishes would be advantageous.

BRIEF DESCRIPTION OF THE INVENTION

In accordance with one embodiment, a dishwasher appliance defining a vertical, a lateral, and a transverse direction is provided. The dishwasher appliance includes a wash tub that defines a wash chamber, a fluid circulation assembly for providing a fluid flow within the wash chamber, and a lower rack assembly. The lower rack assembly includes a lower rack configured for receipt of articles for washing, and a lift assembly connected to the lower rack. The lift assembly includes a gear assembly, the gear assembly including an output spur gear and an input drive gear. The lift assembly further includes a first arm extending between a first end and a second end, the first end of the first arm pivotally coupled to the lower rack, the second end of the first arm coupled to the output spur gear. Movement of the input drive gear causes movement of the lower rack along the transverse direction between a retracted position wherein the lower rack is within the wash chamber and an extended position wherein the lower rack is positioned outside of the wash chamber and along the vertical direction between a lowered position and a raised position wherein the raised position is above the lowered position along the vertical direction.

In accordance with another embodiment, a dishwasher appliance defining a vertical, a lateral, and a transverse direction is provided. The dishwasher appliance includes a wash tub that defines a wash chamber, a fluid circulation assembly for providing a fluid flow within the wash chamber, and a lower rack assembly. The lower rack assembly includes a lower rack configured for receipt of articles for washing, and a lift assembly connected to the lower rack. The lift assembly includes a gear assembly, the gear assembly including a gear assembly, the gear assembly including an output spur gear and a manually driven input rack gear. The lift assembly further includes a first arm extending between a first end and a second end, the first end of the first arm pivotally coupled to the lower rack, the second end of the first arm coupled to the output spur gear. Movement of the input rack gear causes movement of the lower rack along the transverse direction between a retracted position wherein the lower rack is within the wash chamber and an extended position wherein the lower rack is positioned outside of the wash chamber and along the vertical direction between a lowered position and a raised position wherein the raised position is above the lowered position along the vertical direction.

In accordance with another embodiment, a dishwasher appliance defining a vertical, a lateral, and a transverse direction is provided. The dishwasher appliance includes a wash tub that defines a wash chamber, a fluid circulation assembly for providing a fluid flow within the wash chamber, and a lower rack assembly. The lower rack assembly includes a lower rack configured for receipt of articles for washing, and a lift assembly connected to the lower rack. The lift assembly includes a gear assembly, the gear assembly including an output spur gear and an input spur gear. The lift assembly further comprises a motor operable to rotate the input spur gear. The lift assembly further comprises a first arm extending between a first end and a second end, the first end of the first arm pivotally coupled to the lower rack, the second end of the first arm coupled to the output spur gear. Rotation of the input spur gear causes movement of the lower rack along the transverse direction between a retracted position wherein the lower rack is within the wash chamber and an extended position wherein the lower rack is positioned outside of the wash chamber and along the vertical direction between a lowered position and a raised position wherein the raised position is above the lowered position along the vertical direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
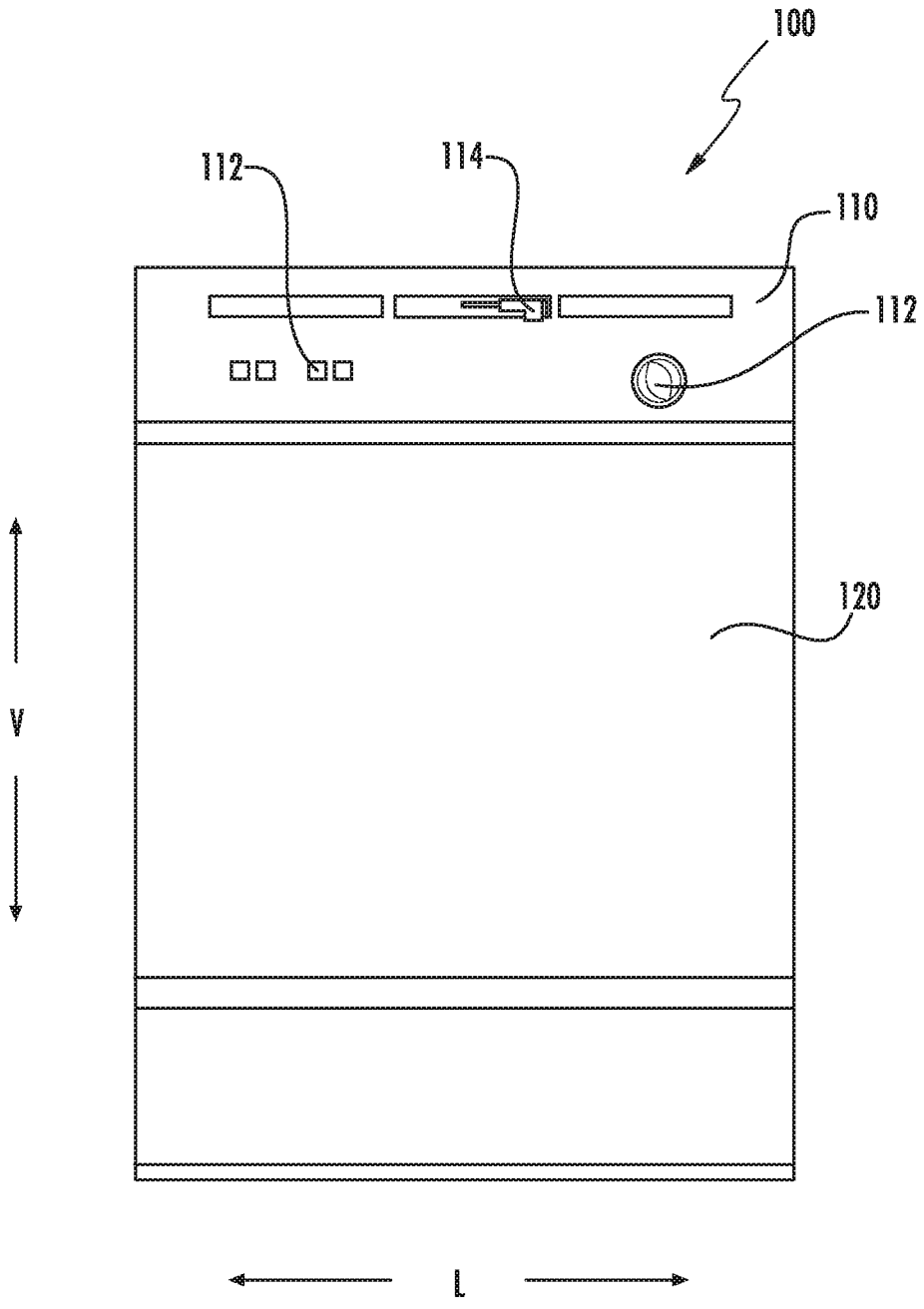
FIG. 1 provides a front elevation view of a dishwasher appliance in accordance with embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
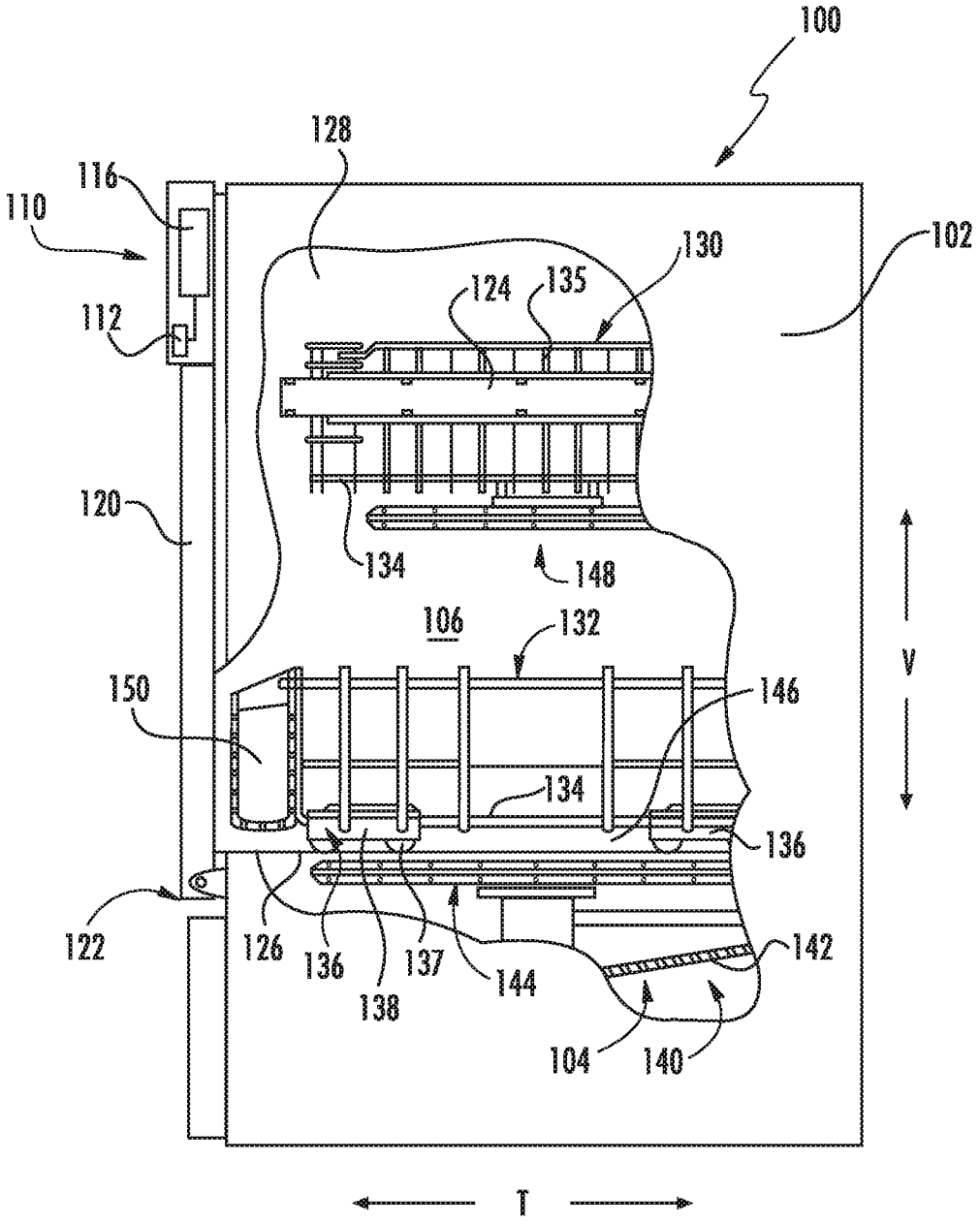
FIG. 2 provides a partial side section view of a dishwasher appliance in accordance with embodiments of the present disclosure.
Figure 3:
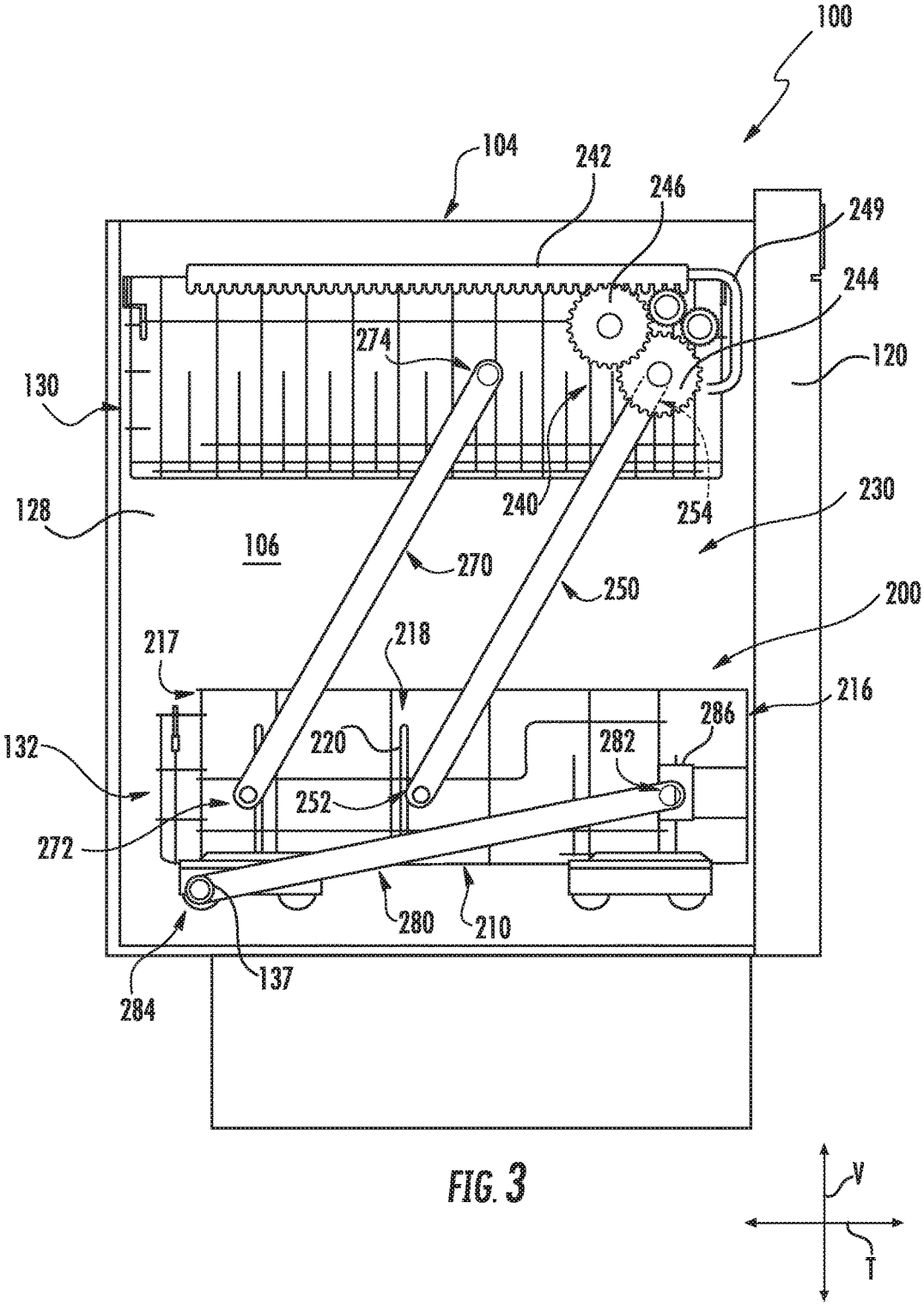
FIG. 3 provides a side view of a dishwasher appliance, including internal and external components of a rack assembly, in accordance with embodiments of the present disclosure.
Figure 4:
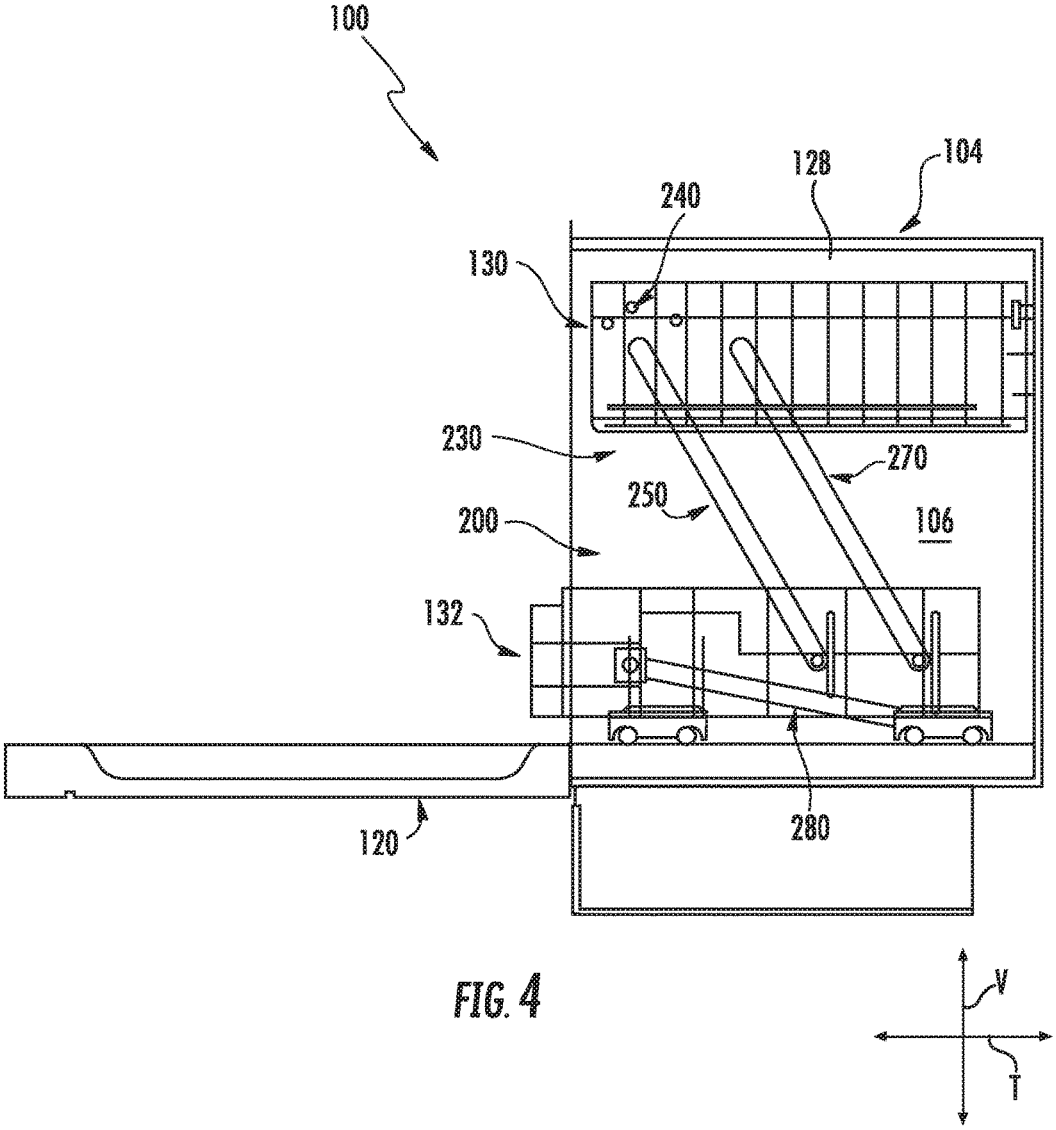
FIG. 4 provides a side cross-sectional view of the dishwasher appliance of FIG. 3, with a lower rack assembly in a retracted, lowered position in accordance with embodiments of the present disclosure.
Figure 5:
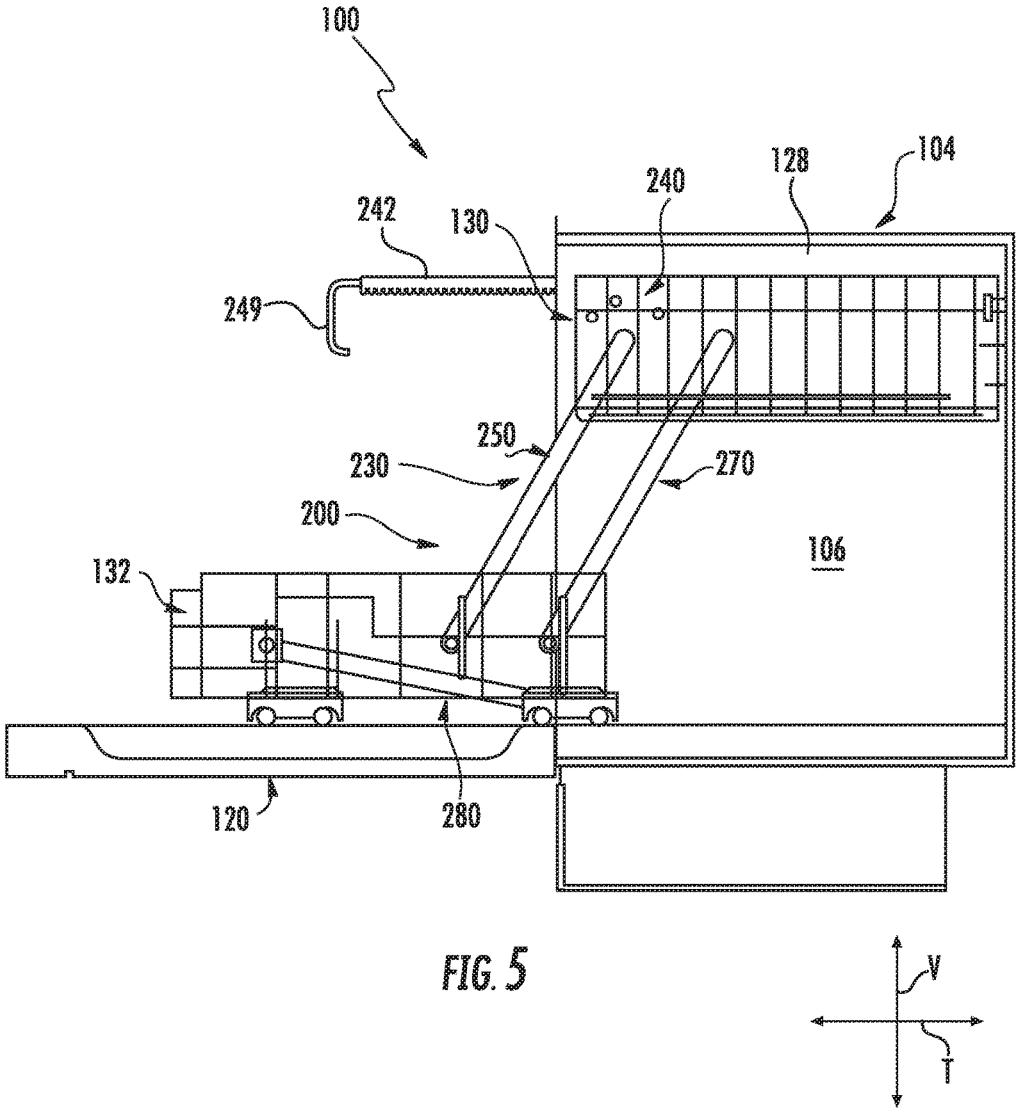
FIG. 5 provides a side cross-sectional view of the dishwasher appliance of FIG. 3, with a lower rack assembly in an extended, lowered position in accordance with embodiments of the present disclosure.

FIGS. 1 and 2 depict a dishwasher appliance 100 according to an exemplary embodiment of the present subject matter. Dishwasher appliance 100 defines a vertical direction V, a lateral direction L (FIG. 1) and a transverse direction T (FIG. 2). The vertical, lateral, and transverse directions V, L, and T are mutually perpendicular and form an orthogonal direction system.

Dishwasher appliance 100 includes a chassis or cabinet 102 having a tub 104. Tub 104 defines a wash chamber 106 and includes a front opening (not shown) and a door 120 hinged at its bottom 122 for movement between a normally closed vertical position (shown in FIGS. 1 and 2), wherein wash chamber 106 is sealed shut for washing operation, and a horizontal open position for loading and unloading of articles from dishwasher appliance 100. A latch 114 is used to lock and unlock door 120 for access to chamber 106.

Slide assemblies 124 are mounted on opposing tub sidewalls 128 to support and provide for movement of an upper rack 130. Lower guides 126 are positioned in opposing manner of the sides of chamber 106 and provide a ridge or shelf for roller assemblies 136 so as to support and provide for movement of a lower rack 132. Each of the upper and lower racks 130 and 132 is fabricated into lattice structures including a plurality of elongated members 134 and 135 that extend in lateral (L), transverse (T), and/or vertical (V) directions. Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by slide assemblies 124 and roller assemblies 136 that carry the upper and lower racks 130 and 132, respectively. A silverware basket 150 may be removably attached to the lower rack 132 for placement of silverware, small utensils, and the like, that are too small to be accommodated by the upper and lower rack assemblies 130, 132.

Dishwasher appliance 100 also includes a lower spray assembly 144 that is rotatably mounted within a lower region 146 of the wash chamber 106 and above a tub sump portion 142 so as to rotate in relatively close proximity to lower rack 132. A spray arm or mid-level spray assembly 148 is located in an upper region of the wash chamber 106 and may be located in close proximity to upper rack 130. Additionally, an upper spray assembly (not shown) may be located above the upper rack 130 and mounted to an upper wall of tub 104.

Lower and mid-level spray assemblies 144, 148 and the upper spray assembly are fed by a fluid circulation assembly for circulating water and wash fluid in the tub 104. Portions of the fluid circulation assembly may be located in a machinery compartment 140 located below tub sump portion 142 of tub 104, as generally recognized in the art. Each spray assembly includes an arrangement of discharge ports or orifices for directing washing liquid onto dishes or other articles located in upper and lower rack assemblies 130, 132, respectively. The arrangement of the discharge ports in at least the lower spray assembly 144 provides a rotational force by virtue of washing fluid flowing through the discharge ports. The resultant rotation of lower spray assembly 144 provides coverage of dishes and other articles with a washing spray.

Dishwasher appliance 100 is further equipped with a controller 116 to regulate operation of dishwasher appliance 100. Controller 116 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 116 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 116 may be positioned in a variety of locations throughout dishwasher appliance 100. In the illustrated embodiment, controller 116 may be located within a control panel area 110 of door 120 as shown. In such an embodiment, input/output ("I/O") signals may be routed between the control system and various operational components of dishwasher appliance 100 along wiring harnesses that may be routed through bottom 122 of door 120. Typically, the controller 116 includes a user interface panel 112 through which a user may select various operational features and modes and monitor progress of the dishwasher appliance 100. In one embodiment, user interface panel 112 may represent a general purpose I/O ("GPIO") device or functional block. In one embodiment, the user interface panel 112 may include input components, such as one or more of a variety of electrical, mechanical or electro-mechanical input devices including rotary dials, push buttons, and touch pads. User interface panel 112 may include a display component, such as a digital or analog display device designed to provide operational feedback to a user. User interface panel 112 may be in communication with controller 116 via one or more signal lines or shared communication busses.

It should be appreciated that the present subject matter is not limited to any particular style, model, or configuration of dishwasher appliance. Thus, the exemplary embodiment depicted in FIGS. 1 and 2 is provided for illustrative purposes only. For example, different locations may be provided for a user interface 112, different configurations may be provided for upper and lower racks 130, 132 and/or lower and mid-level spray assemblies 144, 148, and other differences may be applied as well.

FIGS. 3 through 10 illustrate embodiments and components of a lower rack assembly 200 in accordance with embodiments of the present disclosure. Lower rack assemblies 200 in accordance with the present disclosure advantageously facilitate lifting of the lower rack 132 as desired to, for example, load or unload articles. Further, lower rack assemblies 200 in accordance with the present disclosure may advantageously be cost effective and may facilitate lifting and lowering in a smooth, uniform and ergonomic manner.

Lower rack assembly 200 may include, for example, lower rack 132. The lower rack 132 may define an interior volume 206. In particular, a bottom wall 210, a back wall 216, a front wall 217 and side walls 218, 219 of rack assembly 200 may assist with defining interior volume 206 of rack assembly 200. Thus, interior volume 206 of rack assembly 200 may be defined between bottom wall 210, back wall 216, front wall 217 and side walls 218, 219 of rack assembly 200. Articles for washing, such as cups, bowls, bottles, etc., may be placed or positioned within interior volume 206 of rack assembly 200 such that the articles for washing are supported by rack assembly 200 during operation of dishwasher appliance 100.

Figure 6:
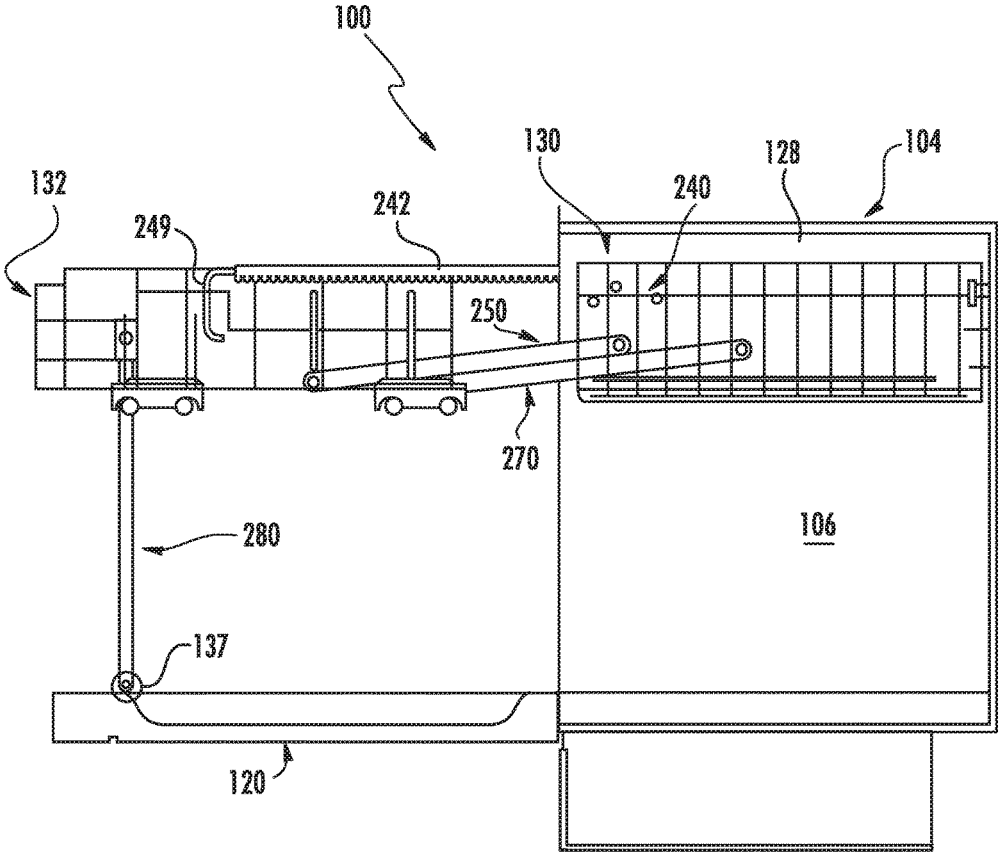
FIG. 6 provides a side cross-sectional view of the dishwasher appliance of FIG. 3, with a lower rack assembly in an extended, raised position in accordance with embodiments of the present disclosure.
Figure 7:
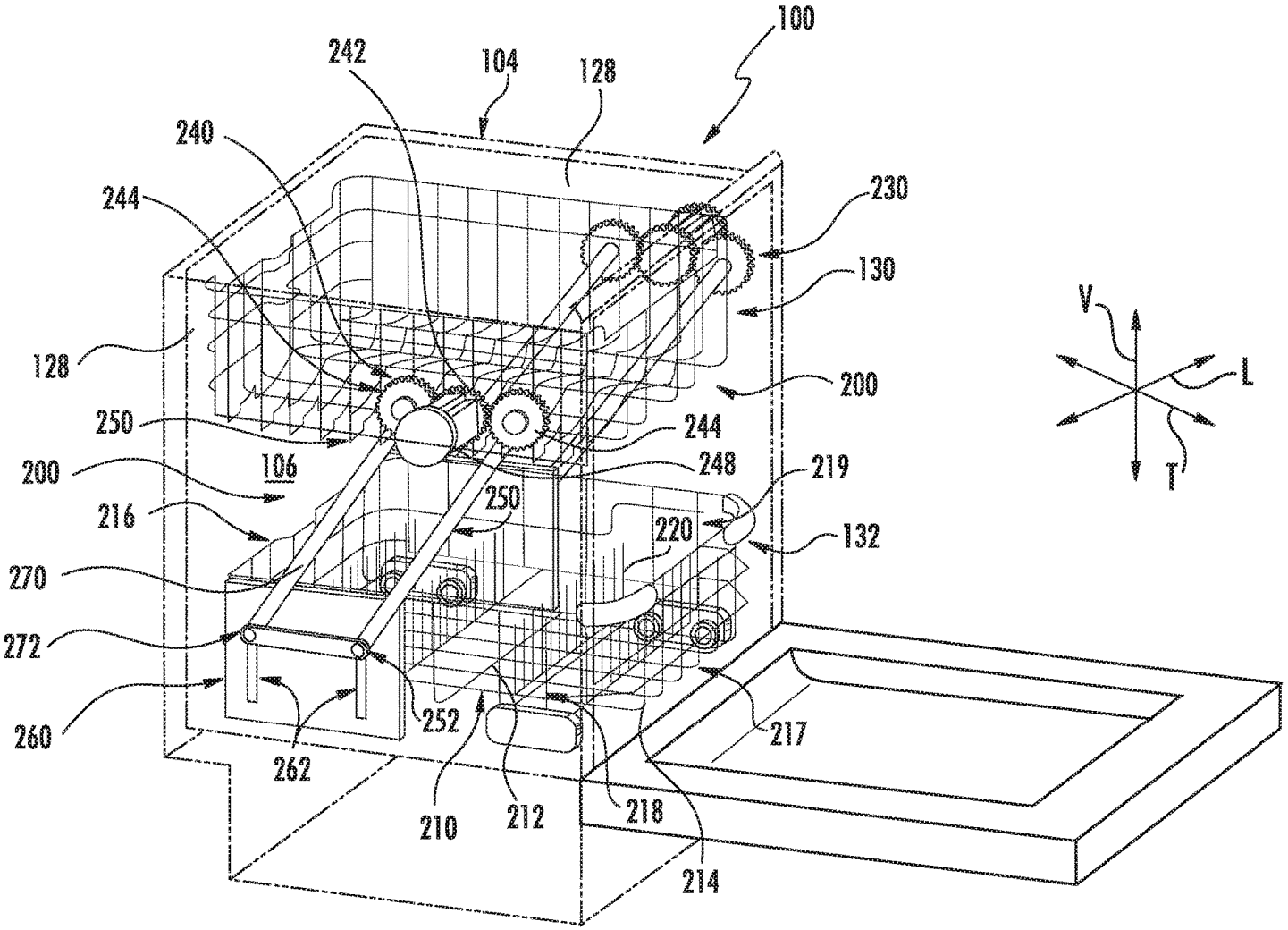
FIG. 7 provides a perspective view of a dishwasher appliance, including internal and external components of a rack assembly, in accordance with embodiments of the present disclosure.
Figure 8:
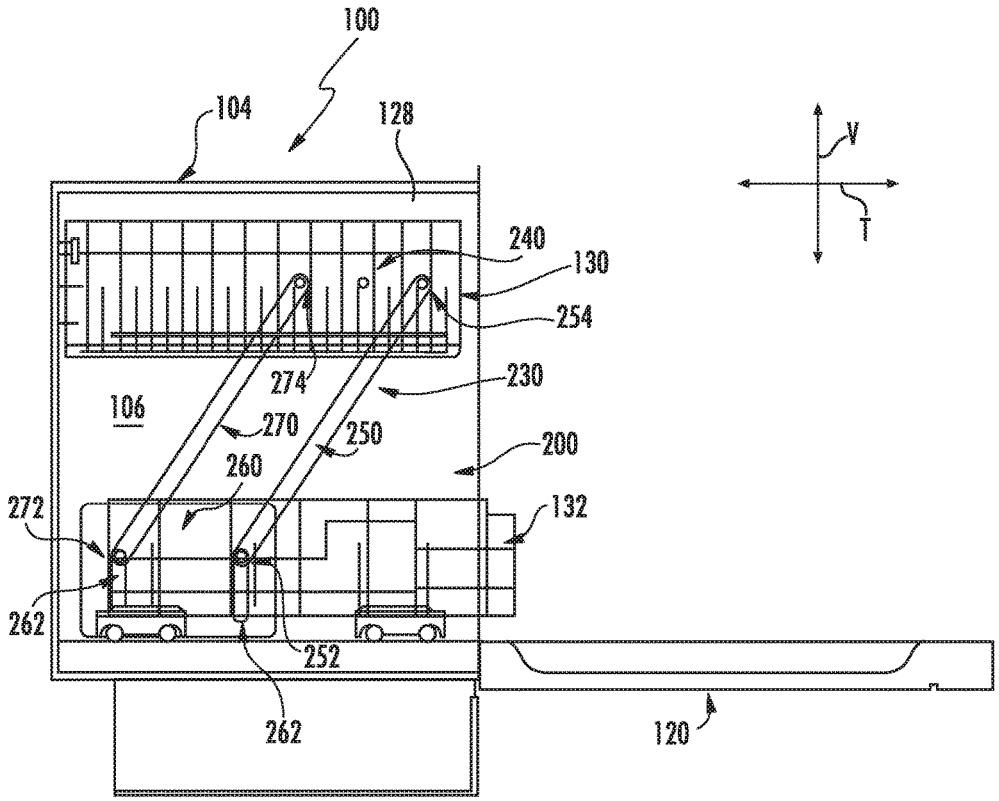
FIG. 8 provides a side cross-sectional view of the dishwasher appliance of FIG. 7, with a lower rack assembly in a retracted, lowered position in accordance with embodiments of the present disclosure.
Figure 9:
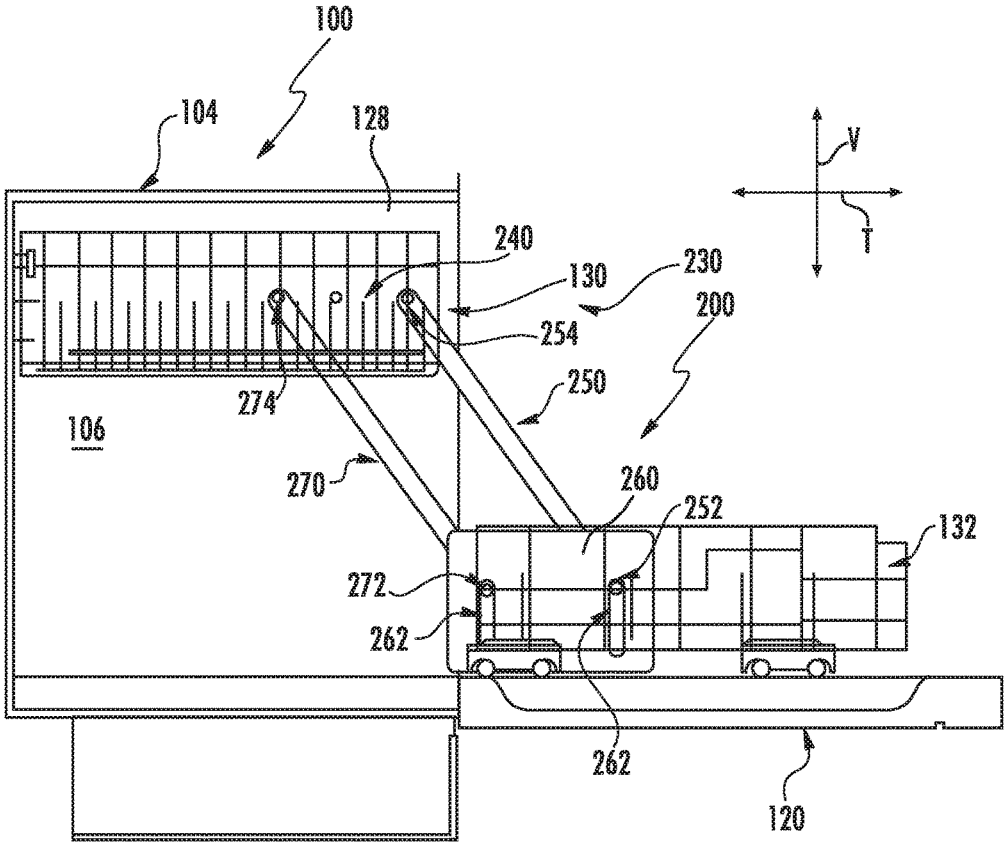
FIG. 9 provides a side cross-sectional view of the dishwasher appliance of FIG. 7, with a lower rack assembly in an extended, lowered position in accordance with embodiments of the present disclosure.

Rack assembly 200 can also include a plurality of tines 220, which as shown are fixed tines but alternatively may be rotatable tines, for assisting with supporting articles within interior volume 206 of rack assembly 200. Tines 220 are mounted to bottom wall 210 of rack assembly 200 and extend into interior volume 206 of rack assembly 200, e.g., upwardly along the vertical direction V. In particular, as shown in FIG. 6, bottom wall 210 may include a series of lateral members 212 fixed to a series of transverse members 214. Each lateral member of lateral members 212 extends along the lateral direction L. Lateral members 212 are also spaced apart from one another along the transverse direction T. Similarly, each transverse member of transverse members 214 extend along the transverse direction T. Transverse members 214 are also spaced apart from one another along the lateral direction L. Thus, lateral members 212 and transverse members 214 form a lattice structure for containing articles within rack assembly 200. Fixed tines 220 may be mounted or fixed (e.g., welded) to lateral members 212 and/or transverse members 214 of bottom wall 210 of rack assembly 200 and extend into interior volume 206 of rack assembly 200, e.g., upwardly along the vertical direction V, from bottom wall 210.

In exemplary embodiments, rack assembly 200 further includes one or more roller assemblies 136, each of which may include one or more wheels 137 and a carriage 138 which is generally connected to the wheels 137. One or more roller assemblies 136 may be positioned each sidewall 218, 219. The roller assemblies 136 may facilitate movement of the rack assembly 200 along the transverse direction T. For example, as illustrated, rack assembly 200 is movable along the transverse direction T between a retracted position (see FIGS. 3, 4, 7 and 8) wherein the lower rack 132 is within the wash chamber 106 and an extended position (see FIGS. 5, 6, 9 and 10) wherein the lower rack 132 is positioned outside of the wash chamber 106. Wheels 137 may contact and roll along the inner surface of door 120 to move the rack assembly 200 along the transverse direction T as required.

Lower rack assembly 200 further includes one or more lift assemblies 230. Each lift assembly 230 may be connected to the lower rack 132 and may facilitate raising and lowering of the lower rack 132. For example, in exemplary embodiments, lower rack assembly 200 may include two lift assemblies 230; one lift assembly 230 may be disposed proximate and connected to the sidewall 218, and another lift assembly 230 may be disposed proximate and connected to the opposing sidewall 219.

Lift assembly 230 may include a gear assembly 240. As illustrated, gear assembly 240 may be disposed above the lower rack 132 along the vertical direction V, and may for example be adjacent to the upper rack 130. Components of the gear assembly 240, such as gears thereof, may be disposed exterior to the tub 104. Further, components of the gear assembly, such as shafts connected to gears, may extend through sidewalls 128 of the tub 104 into the wash chamber 106. In alternative embodiments, however, the entire gear assembly 240 may be disposed within the wash chamber 106. Movement of the gear assembly 240 may generally drive movement of the lower rack 132. In particular, the gear assembly 240 may include an input drive gear 242 and an output spur gear 244. Movement of the input drive gear 242 may generally drive movement (such as rotation) of the output spur gear 244, which may in turn drive movement of the lower rack 132.

Figure 10:
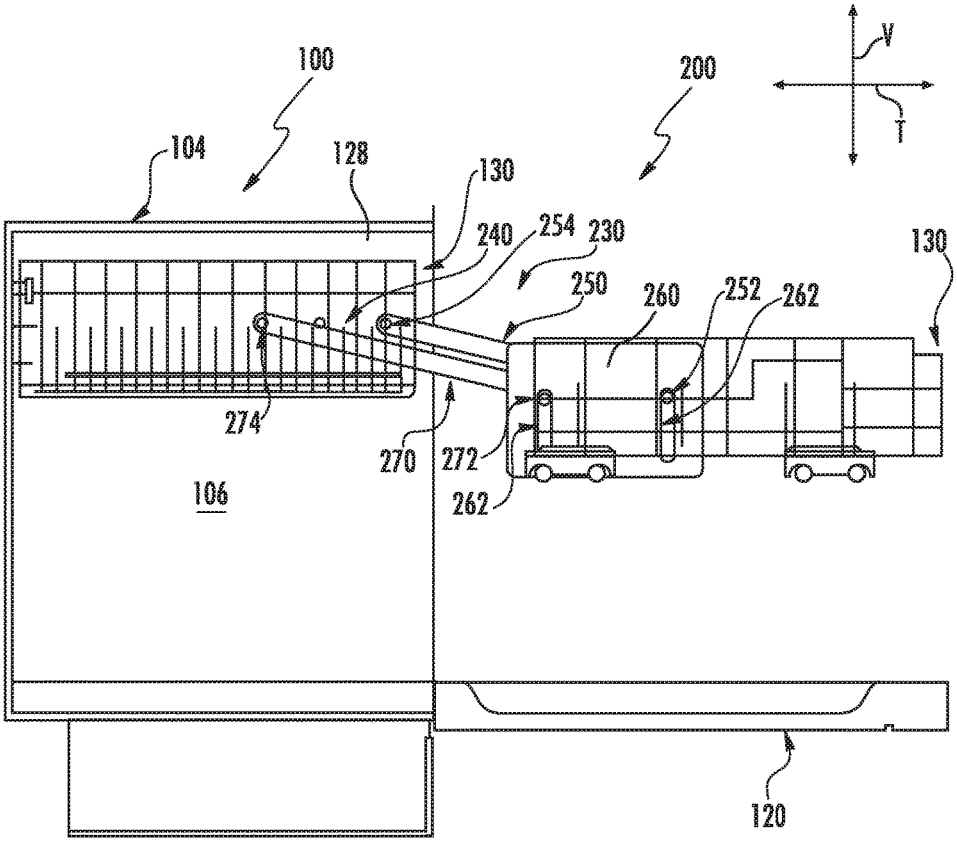
FIG. 10 provides a side cross-sectional view of the dishwasher appliance of FIG. 7, with a lower rack assembly in an extended, raised position in accordance with embodiments of the present disclosure.

Movement of the input drive gear 242 may cause movement of the lower rack 132 along the transverse direction T between a retracted position and an extended position. In the retracted position, the lower rack 132 is within the wash chamber 106, as discussed above. In the extended position, the lower rack 132 is positioned outside of the wash chamber 106, as discussed above. Movement of the input drive gear 242 may further cause movement of the lower rack 132 along the vertical direction V between a lowered position (see FIGS. 3-5 and 7-9) and a raised position (see FIGS. 6 and 10). In raised position, the lower rack is above the lowered position along the vertical direction V, as shown. In exemplary embodiments, movement of the input drive gear 242 in a first direction causes movement of the lower rack 132 first along the transverse direction T from the retracted position (FIGS. 4 and 8) to the extended position (FIGS. 5 and 9) and second along the vertical direction V from the lowered position (FIGS. 5 and 9) to the raised position (FIGS. 6 and 10). Movement of the input drive gear 242 in a second opposite direction may cause opposite movement of the lower rack 132, first from the raised position to the lowered position and second from the extended position to the retracted position.

In some embodiments, as illustrated in FIGS. 3 through 6, the input drive gear 242 may be linearly movable (such as in a first direction and second opposite direction), such as along the transverse direction T. For example, the input drive gear 242 may in exemplary embodiments be a rack gear, as illustrated. Such linear movement, such as of the input rack gear 242, may cause movement, such as rotation, of the output spur gear 244. Further, in some embodiments, as illustrated, gear assembly 240 may further include a pinion gear 246 rotatably meshed between the input drive gear 242 and the output spur gear 244. Additionally, in some embodiments as illustrated, additional intermediate gears may be provided and may be rotatably meshed with the input drive gear 242 and/or output spur gear 244. Alternatively, the input drive gear 242 may be directly rotatably meshed with the output spur gear 244.

In alternative embodiments, as illustrated in FIGS. 7 through 10, the input drive gear 242 may be rotatably movable, (such as in a first direction and second opposite direction), such as about the lateral direction L. For example, the input drive gear 242 may in exemplary embodiments be a spur gear, as illustrated. Such rotational movement, such as of the input spur gear 242, may cause movement, such as rotation, of the output spur gear 244. In some embodiments, as illustrated, the input drive gear 242 may be directly rotatably meshed with the output spur gear 244. Alternatively, in some embodiments, various intermediate gears may be provided and may be rotatably meshed with the input drive gear 242 and/or output spur gear 244.

Further, in some embodiments the gear assembly 240 may be manually operated and driven, while in other embodiments the gear assembly 240 may be driven by, for example a motor 248. The motor 248 may for example be manually actuated by a user as desired, or automatically actuated by controller 116 at suitable times, such as upon opening of door 120.

For example, FIGS. 3 through 6 illustrate one embodiment of a manually actuated gear assembly 240. As shown, a handle 249 may be connected to the input drive gear 242. A user can grasp the handle 249 and pull, push or otherwise move the handle 249 to move the input drive gear 242.

FIGS. 7 through 10 illustrate one embodiment of a motor-driven gear assembly 240. Motor 248 is operable to move the input drive gear 242. For example, as shown, the motor 248 may be connected to the input drive gear 242 via a motor shaft. Actuation of the motor 248 may cause rotation of the input drive gear 242.

Referring again to FIGS. 3 through 10, movement of the lower rack 132 may be caused by movement of the gears of the gear assembly 240 and movement of a first arm 250 coupled to the gear assembly 240. First arm 250 may extend between a first end 252 and a second end 254. The first end 252 may, for example, be pivotally coupled to the lower rack 132, such as to a sidewall 218, 219 thereof. For example, the first end 252 may be coupled to the lower rack 132 via a suitable mechanical fastener, or via a bracket such as bracket 260 (see FIGS. 7 through 10) which is connected to the sidewall 218, 219. Bracket 260 may define a slot 262, which may be vertically extending and in which the first end 252 may be rotatably and slidably disposed.

The second end 254 may, for example, be coupled to the output spur gear 244. In exemplary embodiments, rotation of the output spur gear 244 causes rotation of the first arm 250. For example, the second end 254 may be fixedly coupled to the output spur gear 244, such that rotation of the output spur gear 244 causes rotation of the second end 254. Rotation of the second end 254 may cause rotation of the first end 252 (and remainder of the first arm 250) relative to the second end 254 and output spur gear 244. The rotation of the first arm 250 may, in turn, cause movement of the lower rack 132. As illustrated, for example, rotation of the first arm 250 may cause movement of the lower rack 132 from the retracted position to the extended position (and vice versa) and from the lowered position to the raised position (and vice versa).

Additional arms may be provided to facilitate movement of the lower rack 132. For example, a second arm 270 may be provided. Second arm 270 may extend between a first end 272 and a second end 274. The first end 272 may, for example, be pivotally coupled to the lower rack 132, such as to a sidewall 218, 219 thereof. For example, the first end 272 may be coupled to the lower rack 132 via a suitable mechanical fastener, or via a bracket such as bracket 260 (see FIGS. 7 through 10) which is connected to the sidewall 218, 219. Bracket 260 in these embodiments defines a plurality of slots, each of which may be vertically extending and in one of which the first end 272 may be rotatably and slidably disposed.

In some embodiments, as illustrated, in FIGS. 3 through 6, the second end 274 may be pivotally coupled to a sidewall 128 of the tub 104. In these embodiments, the second arm 270 is a passive arm which simply provides stability to the lift assembly 230. In other embodiments, as illustrated in FIGS. 7 through 10, the second arm 270 may be an active arm which additionally causes (when moved by gear assembly 240) movement of the lower rack 132. For example, the gear assembly 240 in some embodiments may include a plurality of output spur gears 244. The output spur gears 244 may be movably driven, such as rotatably driven, by the input drive gear 242. The second end 254 of the first arm 250 may be coupled to one of the plurality of output spur gears 244, and the second end 274 of the second arm 270 may be coupled to another of the plurality of output spur gears 244. The second end 274 may, for example, be coupled to the output spur gear 244. In exemplary embodiments, rotation of the output spur gear 244 causes rotation of the second arm 270. For example, the second end 274 may be fixedly coupled to the output spur gear 244, such that rotation of the output spur gear 244 causes rotation of the second end 274. Rotation of the second end 274 may cause rotation of the first end 272 (and remainder of the second arm 270) relative to the second end 274 and output spur gear 244. The rotation of the second arm 270 may, in turn, cause movement of the lower rack 132. As illustrated, for example, rotation of the second arm 270 may cause movement of the lower rack 132 from the retracted position to the extended position (and vice versa) and from the lowered position to the raised position (and vice versa).

In some embodiments, as illustrated in FIGS. 3 through 6, an auxiliary support arm 280 may additionally be provided. Auxiliary support arm 280 may extend between a first end 282 and a second end 284. The first end 282 may, for example, be pivotally coupled to the lower rack 132, such as to a sidewall 218, 219 thereof. For example, the first end 282 may be coupled to the lower rack 132 via a suitable mechanical fastener, or via a bracket such as bracket 286 which is connected to the sidewall 218, 219. The second end 284 may be a free end which is pivotally coupled to a wheel 137 (which is separate from roller assemblies 136). The wheel 137 may, when the lower rack 132 is moved to the extended position, contact an inner surface of the door 120.

Further, when the lower rack 132 moves from the lowered position to the raised position, the auxiliary support arm 280 and second end 284 thereof may pivot about the first end 282 such that the wheel 137 remains in contact with the inner surface of the door 120. The auxiliary support arm 280 is additionally pivotable in the opposite direction when the lower rack 132 moves from the raised position to the lowered position. Accordingly, the auxiliary support arm 280 may provide additional support to the lower rack 132 when in the raised position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance defining a vertical, a lateral, and a transverse direction, the dishwasher appliance comprising:

a wash tub that defines a wash chamber;

a fluid circulation assembly for providing a fluid flow within the wash chamber; and a lower rack assembly, the lower rack assembly comprising:

a lower rack configured for receipt of articles for washing, the lower rack extending along the lateral direction between a front end of the lower rack and a rear end of the lower rack;

a lift assembly connected to the lower rack, the lift assembly comprising:

a gear assembly, the gear assembly comprising an output spur gear and an input drive gear;

a first arm extending between a first end of the first arm and a second end of the first arm, the first end of the first arm pivotally coupled to the lower rack, the second end of the first arm coupled to the output spur gear;

wherein movement of the input drive gear causes movement of the lower rack along the transverse direction between a retracted position wherein the lower rack is within the wash chamber and an extended position wherein the lower rack is positioned outside of the wash chamber and along the vertical direction between a lowered position and a raised position wherein the raised position is above the lowered position along the vertical direction, wherein the lift assembly further comprises an auxiliary support arm extending between a first end of the auxiliary support arm and a second end of the auxiliary support arm, the first end of the auxiliary support arm pivotally coupled to the lower rack proximal to the front end of the lower rack and distal to the rear end of the lower rack, the second end of the auxiliary support arm being a free end coupled to a wheel, wherein the wheel is rotatably mounted on the second end of the auxiliary support arm, wherein the lowered position includes the second end of the auxiliary support arm proximal to the rear end of the lower rack and distal to the front end of the lower rack, and wherein the raised position includes the second end of the auxiliary support arm rotated forward and positioned underneath the front end of the lower rack.

2. The dishwasher appliance of claim 1, wherein movement of the input drive gear in a first direction causes movement of the lower rack first along the transverse direction from the retracted position to the extended position and second along the vertical direction from the lowered position to the raised position.

3. The dishwasher appliance of claim 1, wherein rotation of the output spur gear causes rotation of the first arm.

4. The dishwasher appliance of claim 1, wherein the input drive gear is a rack gear.

5. The dishwasher appliance of claim 4, wherein the gear assembly further comprises a pinion gear rotatably meshed between the input drive gear and the output spur gear.

6. The dishwasher appliance of claim 1, wherein the input drive gear is manually operated.

7. The dishwasher appliance of claim 1, wherein the lift assembly further comprises a second arm extending between a first end of the second arm and a second end of the second arm, the first end of the second arm pivotally coupled to the lower rack.

8. The dishwasher appliance of claim 7, wherein the second end of the second arm is pivotally coupled to a sidewall of the wash tub.

9. A dishwasher appliance defining a vertical, a lateral, and a transverse direction, the dishwasher appliance comprising:

a wash tub that defines a wash chamber;

a fluid circulation assembly for providing a fluid flow within the wash chamber; and a lower rack assembly, the lower rack assembly comprising:

a lower rack configured for receipt of articles for washing, the lower rack extending along the lateral direction between a front end of the lower rack and a rear end of the lower rack;

a lift assembly connected to the lower rack, the lift assembly comprising:

a gear assembly, the gear assembly comprising an output spur gear and a manually driven input drive gear;

a first arm extending between a first end of the first arm and a second end of the first arm, the first end of the first arm pivotally coupled to the lower rack, the second end of the first arm coupled to the output spur gear;

wherein movement of the input drive gear causes movement of the lower rack along the transverse direction between a retracted position wherein the lower rack is within the wash chamber and an extended position wherein the lower rack is positioned outside of the wash chamber and along the vertical direction between a lowered position and a raised position wherein the raised position is above the lowered position along the vertical direction, wherein the lift assembly further comprises an auxiliary support arm extending between a first end of the auxiliary support arm and a second end of the auxiliary support arm, the first end of the auxiliary support arm pivotally coupled to the lower rack proximal to the front end of the lower rack and distal to the rear end of the lower rack, the second end of the auxiliary support arm being a free end coupled to a wheel, wherein the wheel is rotatably mounted on the second end of the auxiliary support arm, wherein the lowered position includes the second end of the auxiliary support arm proximal to the rear end of the lower rack and distal to the front end of the lower rack, and wherein the raised position includes the second end of the auxiliary support arm rotated forward and positioned underneath the front end of the lower rack.

10. The dishwasher appliance of claim 9, wherein movement of the input rack gear in a first direction causes movement of the lower rack first along the transverse direction from the retracted position to the extended position and second along the vertical direction from the lowered position to the raised position.

11. The dishwasher appliance of claim 9, wherein rotation of the output gear causes rotation of the first arm.

12. The dishwasher appliance of claim 9, wherein the gear assembly further comprises a pinion gear rotatably meshed between the input rack gear and the output spur gear.

* * * * *